US005921207A

United States Patent [19]

DiSalvo et al.

[11] Patent Number: 5,921,207

[45] Date of Patent: Jul. 13, 1999

[54] AUTOMATIC FLUSHING SYSTEM FOR WATER TANK

[76] Inventors: Joseph DiSalvo, 1125 Nelson St., Dunedin, Fla. 34698; Merrick A. Endres, 8609 Stoner Rd., Riverview, Fla. 33569-5245

[21] Appl. No.: 08/852,137

[22] Filed: May 6, 1997

[51] Int. Cl.[6] ..... F22B 37/48

[52] U.S. Cl. ..... 122/388; 122/13.2; 392/451

[58] Field of Search ..... 122/13.2, 380, 122/388; 392/451

[56] References Cited

U.S. PATENT DOCUMENTS

| | | | |
|---|---|---|---|
| 4,043,353 | 8/1977 | Shirey | 137/204 |
| 4,407,315 | 10/1983 | Haberer . | |
| 4,512,289 | 4/1985 | Collins . | |
| 4,714,053 | 12/1987 | Perry . | |
| 4,790,289 | 12/1988 | Barrett . | |
| 4,813,383 | 3/1989 | Daugirda | 122/283 |
| 4,858,563 | 8/1989 | Perry | 122/382 |
| 5,152,843 | 10/1992 | McDonald et al. . | |
| 5,406,935 | 4/1995 | Cinotto | 126/360 |
| 5,609,124 | 3/1997 | Leclerc | 122/388 |
| 5,668,922 | 9/1997 | Ross et al. | 122/13.2 |

*Primary Examiner*—Teresa Walberg
*Assistant Examiner*—Gregory A. Wilson
*Attorney, Agent, or Firm*—Malin, Haley, DiMaggio & Crosby, P.A.

[57] ABSTRACT

A system for periodically flushing accumulated sediment from hot water tanks including a drain valve controlled by an electric actuating means capable of rapid actuation of the valve from its normally closed position to a fully open position. The electric actuating means is electrically connected to a timing means, such as a time clock, for actuating periodic flush cycles. A flush cycle begins when the appropriate signal commands the actuating means to open the valve and ends upon closure of the valve. The invention contemplates that the duration of each flush cycle will depend on the water tank size, and that a series of flush cycles will provide optimized flushing of sediment from the tank.

6 Claims, 2 Drawing Sheets

AUTOMATIC FLUSHING SYSTEM FOR WATER TANK

BACKGROUND OF THE INVENTION

1. Field of the Invention

The present invention relates to water tanks, and specifically to an automatic flushing system for flushing accumulated sediment from electric and gas hot water tanks and the like.

2. Description of the Prior Art

Hot water tanks provide a well known means for providing a source of domestic and commercial hot water. Conventional hot water tanks include a cylindrical glass lined water holding tank structure enclosed within a metal tank cover. An electric hot water tank uses electric heating elements projecting into the water holding tank to raise and maintain the water temperature. Typically, a plurality of electric heating elements are arranged in spaced vertical configuration. Similarly, gas hot water tanks include one or more heat exchangers in thermal contact with the water within the tank.

Such tanks further include various piping connections including cold water feed piping which supplies water to the tank, hot water feed piping for delivering hot water to various plumbing fixtures and a valved drain typically located on the sidewall of the tank, near the bottom. Since water tends to stratify along various temperature gradients, the hot water within the tank migrates toward the top, while colder water within the tank migrates toward the bottom. Accordingly, the hot water feed piping draws water from the top of the tank, while the cold water feed piping extends downward via a cold water fill tube, terminating near the bottom of the tank, for introducing cold water at the bottom of the tank.

A common problem experienced with all hot water tanks involves the accumulation of sediment at the bottom of the tank. This problem results from the precipitation of sediment out of the water in the tank, which sediment settles to the bottom of the tank. While the composition of the sediment, and the degree of accumulation naturally depends on the quality of the water supply, the problem persists and the accumulation of sediment greatly reduces the efficiency and operating life of the tank. For example, accumulated sediment is a thermal insulator and the accumulation of sediment on the heating elements reduces heat transfer efficiency. In electric hot water tanks, sediment can accumulate to the point where one or more of the lower electric heating elements are completely covered, thereby drastically reducing heat transfer efficiency and causing premature failure of the heating element(s) by overheating and burnout. Furthermore, the accumulation of sediment in the tank contributes to accelerated corrosion, ultimately leading to leaks which require the wholesale replacement of the tank.

Accordingly, several prior art patents are directed to solving the problems associated with sediment accumulation. For example, U.S. Pat. No. 4,714,053, issued to Perry, discloses a water heater cleaning apparatus which includes a water supply tube terminating in a nozzle for forming a horizontal spray pattern along the tank bottom for flushing sediment toward the tank drain. However, conventional hot water tanks do not include the additional piping and nozzle arrangement required by the Perry device.

U.S. Pat. No. 5,152,843, issued to McDonald et al. discloses a method for removal of hot water heater sediment which involves shutting off and draining the tank, and the insertion of a water-jet probe to direct a water jet toward accumulated sediment.

U.S. Pat. No. 4,790,289, issued to Barrett, discloses a sediment agitating apparatus for a water heater to aid in preventing sediment buildup. The agitating mechanism includes a pump for drawing water from the top of the tank and discharging the water at the bottom of the tank. As discussed above, however, mixing hot water from the top of the tank with cold water from the bottom of the tank is undesirable.

SUMMARY OF THE INVENTION

An automatic flushing system for a conventional hot water tank for the periodic flushing of accumulated sediment from the tank, said system comprising an electrically actuated tank drain valve controlled by a timing mechanism for periodically opening the valve, for a predetermined period of time, thereby causing a sudden and rapid flow of water from the tank, thereby flushing sediment from the tank through the drain valve. The electrically actuated drain valve is preferably a valve capable of providing a full, uninterrupted flow path, when fully open such that sediment flowing through the valve is not impeded by portions of the valve structure.

The invention is suitable for use on all conventional electric and/or gas hot water tanks having at least one fact installed drain valve. The system includes a valve portion controlled by an electric actuating means capable of rapid actuation of the valve from its normally closed position to a fully open position. The electric actuating means is electrically connected to a timing means, such as a time clock, for actuating periodic flush cycles. A flush cycle begins when the appropriate signal commands the actuating means to open the valve and ends upon closure of the valve. The invention contemplates that the duration of each flush cycle will depend on the water tank size, water quality and heating requirements, and that a series of flush cycles will provide optimized flushing of sediment from the tank.

Accordingly, it is an object of the present invention to provide means for automatic, periodic, flushing of sediment from hot water tanks.

It is a further object of the present invention to provide an automatic means for maintaining hot water tanks to extend operating life.

In accordance with these and other objects which will become apparent hereinafter, the instant invention will now be described with particular reference to the accompanying drawings.

DESCRIPTION OF THE PREFERRED EMBODIMENTS

Figure 1:
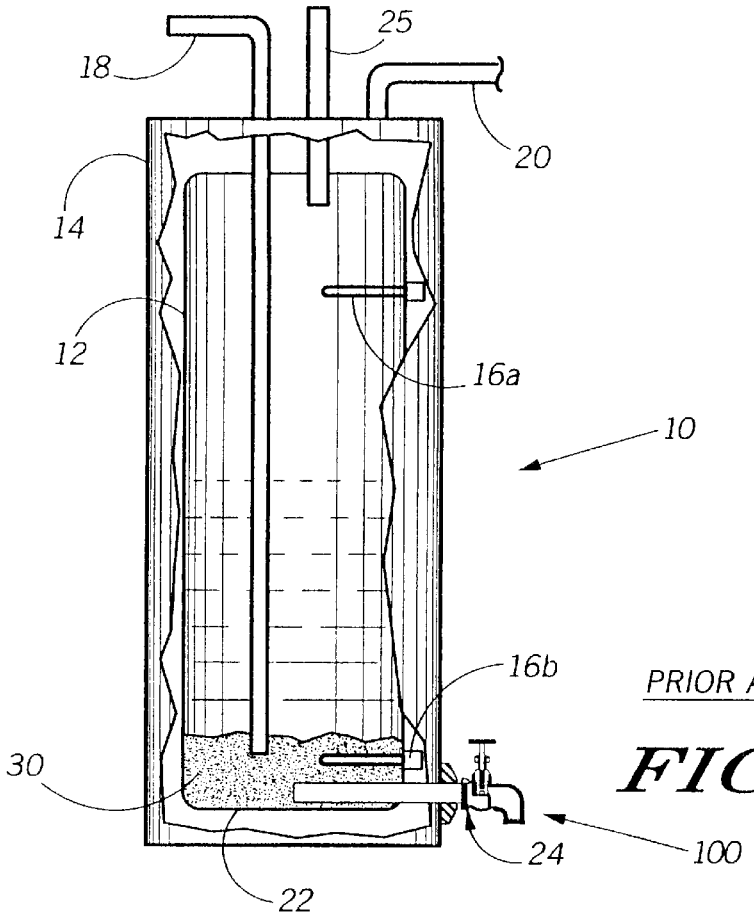
PRIOR ART FIG.1
FIG. 1 is a partial sectional view of a prior art electric hot water tank.

Turning now to the drawings, FIG. 1 shows a cross sectional view of a conventional prior art electric hot water tank, generally referenced as 10. Tank 10 includes a cylindrical glass lined water holding tank 12 enclosed within an insulating layer 13 and housed within metal tank cover 14. An electric hot water tank includes electric heating elements 16*a* and 16*b* projecting into the water holding tank 12 to raise and maintain the water temperature. Typically, the electric heating elements 16*a* and 16*b* are arranged in spaced vertical configuration to minimize temperature stratification.

In addition, the tank further includes various piping connections including cold water feed piping 18 for supplying water to the tank, hot water feed piping 20 for delivering hot water to various plumbing fixtures, a valved drain, generally referenced as 24, typically located on the sidewall of the tank proximate the tank floor 22, and pressure relief piping 25. Drain 24 further includes a retaining ring 23, and a drain pipe 26 extending into tank 12 and terminating therein.

Figure 2:
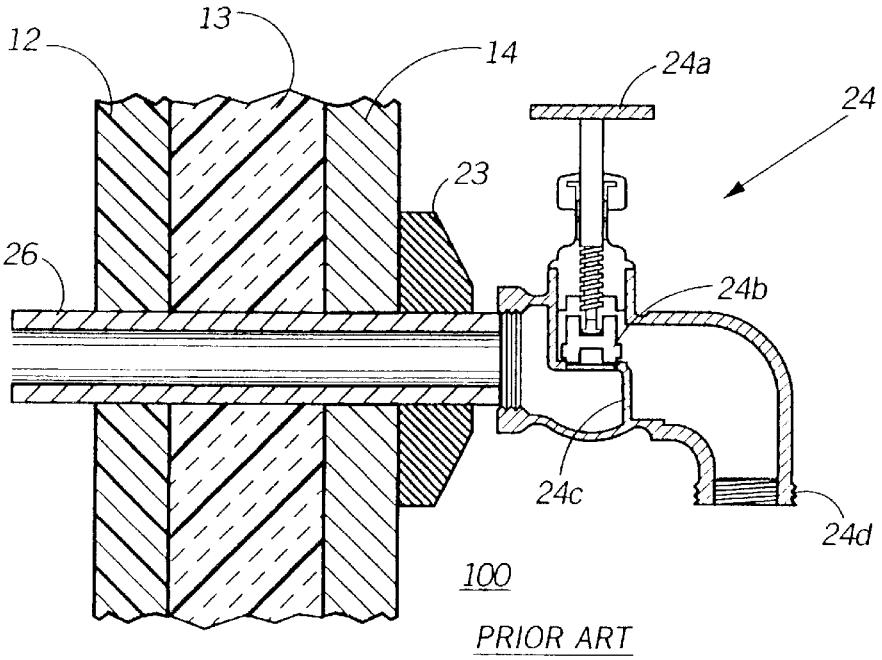
PRIOR ART FIG.2
FIG. 2 is a detail view of the tank drain seen in FIG. 1.

FIG. 2 depicts a more detailed view of the drain area generally shown as 100 in FIG. 1; as depicted in FIG. 2, hot water tank drain valves typically comprise a manual valve 24 which includes a manually rotatable handle 24*a* connected to a movable stop 24*b* which rests in a seat 24*c* formed by the inner valve structure such that the valve is closed when stop 24*b* is seated in seat 24*c* resulting in a no flow condition. Valve 24 further includes a threaded nozzle 24*d*.

Gas hot water tanks are substantially similar to electric hot water tanks, except that gas hot water tanks include one or more heat exchangers in thermal contact with the water within the tank, in lieu of the electric heating elements 16*a* and 16*b*. However, the present invention is equally effective when used with either type of tank; thus, the invention shall be described and shown in connection with an electric tank with the understanding that the operation of the invention does not differ materially when used on gas hot water tanks.

Water tends to stratify along various temperature gradients since the heat within the tank migrates upwardly over time, leaving colder water within the lower portion of the tank. As best shown in FIG. 1, the hot water feed piping 20 draws water from the top of the tank, while the cold water feed piping 18 extends downward, terminating near the bottom of the tank, for introducing cold water proximate the tank floor. This piping configuration insures that hot water drawn from the tank is initially drawn from the upper portion of the tank, while cold water is supplied directly to the lower portion of the tank. This characteristic is a desirable engineering expedient in view of the temperature stratification discussed above. Accordingly, the hottest water is typically found near the top of the tank, and the coldest water is typically found near the bottom of the tank.

As further depicted in FIG. 1, a common problem experienced with hot water tanks is the accumulation of sediment 30 on the tank floor 22. The accumulation of sediment 30 results from particulate matter precipitating from the water within the tank over time. The rate of sedimentary accumulation varies depending on the quality of the water, among other things, and the extent to which the water remains standing in the tank under no flow conditions. As best depicted in FIG. 1, a substantial quantity of sediment can accumulate on the tank floor over time. As further depicted in FIG. 1, sediment accumulating on the tank floor can potentially rise to a level where heat transfer is adversely affected. For example, sedimentary deposits can cake on heat transfer surfaces such as the lower electric heating element 16*b*, as depicted in FIG. 1.

As previously discussed, there are a number a inherent problems with allowing sediment to accumulate and remain in the tank. First, the chemical composition of the sediment contributes to the corrosion critical system components thereby causing premature failure. Second, the formation of a layer of sediment on the heat transfer surfaces reduces the efficiency of the heating element, and, if the heat transfer surface is an electric heating element, deposits on and around the element may cause the element to burn out. Third, the accumulation of sediment reduces the inner volume of tank 12 thereby reducing the amount of water storage volume.

Figure 3:
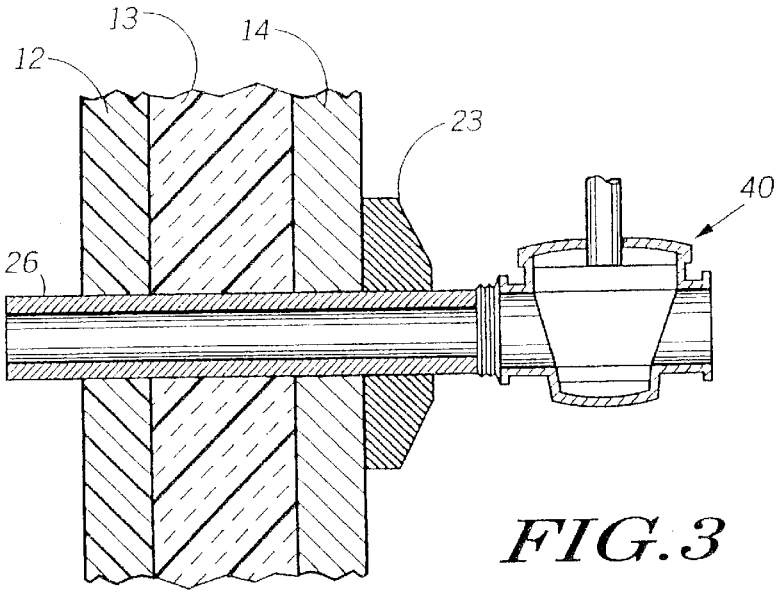
FIG. 3 is a detail view of a tank valve for use with the present invention.
Figure 4A:
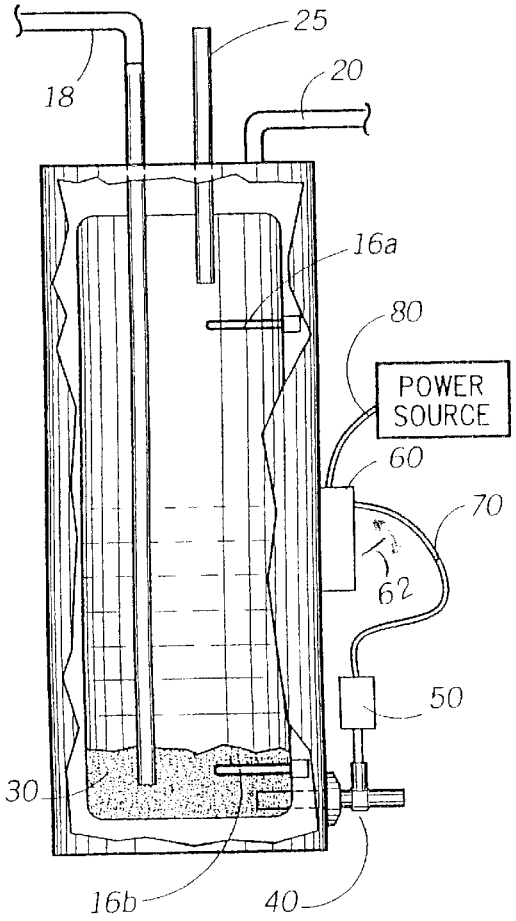
FIG. 4*a* depicts the instant invention installed on an electric hot water tank.
Figure 4B:
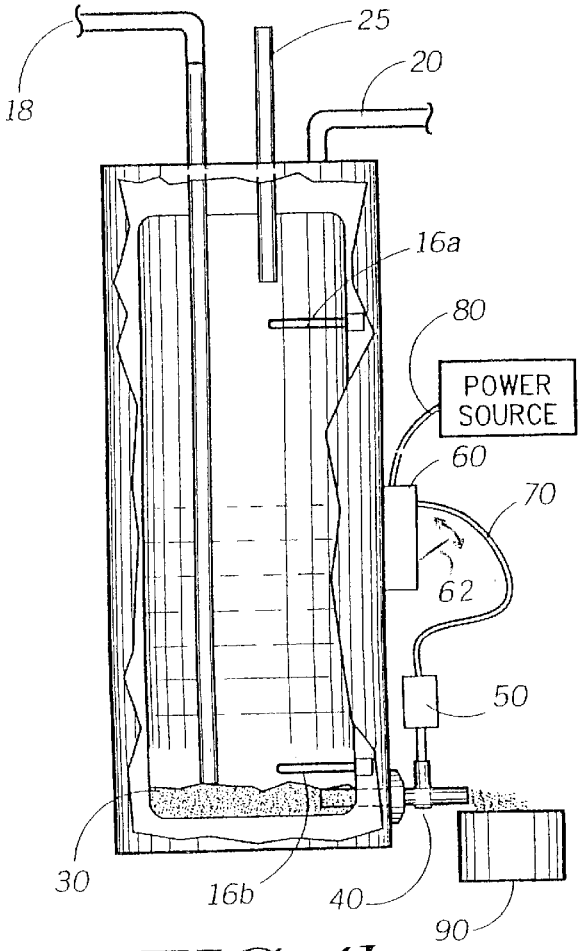
FIG. 4*b* depicts the instant invention installed on an electric hot water tank in the flushing mode.

Accordingly, the present invention provides for the automatic flushing of the tank to remove accumulated sediment thereby maximizing the efficiency and operating life of the tank. With reference now to FIGS. 3, 4*a*, and 4*b*, the present invention is further disclosed. In the preferred embodiment, the manual tank drain valve 24 is removed and replaced by an electrically actuated valve, generally referenced as 40 in FIG. 3. Valve 40 preferably comprises a valve having a structure characterized by an unimpeded flow path when in an open configuration, such as the flow path present in a ball valve. In FIG. 3, valve 40 is depicted in an open configuration thereby forming a water flow path which is substantially free from structural obstructions and the like.

The invention further includes an electric valve actuator 50 for modulating the valve from a normally closed (no flow) position to an open (flow) position. In the preferred embodiment, actuator 50 and valve 40 comprise an integral single piece unit. Electric actuator 50 is electrically connected to a controller 60, by an electrical conductor 70. Controller 60 functions to periodically activate actuator 50 for the purpose of opening and closing valve 40. Controller 60 may be mounted directly on the tank as depicted in FIGS. 4*a* and 4*b*, or may be mounted remotely. In addition, conductors 80 are electrically connected to controller 60 and to an electrical power source whereby controller 60 may be powered by an alternating current source, such as a control transformer associated with the tank, or plugged into a conventional outlet. It is also contemplated that it may be desirable to have controller 60 battery powered.

In the preferred embodiment controller 60 includes a timing capability to initiate tank flushing at regular intervals (e.g. daily, weekly, and monthly), and further controls an individual flush cycle by maintaining valve 40 in an open position for a predetermined period of time. In the preferred embodiment controller 60 is user adjustable such that the user may increase or decrease the flushing frequency and duration.

The operation of the present invention shall now be described with reference to a prior art electric hot water tank. First, the tanks manual valve 24 is removed and replaced with electrically actuated valve 40. It should be apparent that replacement of the manual valve 24 is most easily accomplished when tank 12 is empty, and accordingly, this step is preferably completed prior to installation of a new tank; however, the invention is equally suited for retrofit applications on existing/in-service tanks, in which case the tank is temporarily taken out of service and drained.

Next controller 60 is mounted in a suitable location, and may be affixed directly to metal tank cover 14 as depicted in FIGS. 4*a* and 4*b*. Conductors 80 are then electrically connected to a suitable power source, such as a control transformer which may be associated with the tank.

Finally, controller 60 is programmed by the user for suitable flushing frequency and duration. The inventor has concluded that tank flushing according to the following schedule shall sufficiently remove accumulated sediment.

TANK FLUSHING SCHEDULE

| APPLICATION | FREQUENCY | DURATION |
|---|---|---|
| retrofit installation on existing water heater | five to ten initial flush cycles | five seconds valve open, ten seconds valve closed |
| installation on newly installed water heater | one flush cycle per month | five seconds valve open, ten seconds valve closed |

While the flushing frequencies and durations identified herein above have been determined to be sufficient to remove accumulated sediment, any suitable variation in frequency or duration is considered within the scope of the invention.

Sediment laden water may be directed to a suitable receptacle 90, or, in the alternative, the outlet of valve 40 may be connected to additional drain piping (not shown) such that the water flushed from the tank is routed to a sanitary sewer system. Furthermore, as is now apparent the present invention is suitable for use in a wide variety of applications including use in connection with liquids other than water.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A system for periodically and automatically flushing accumulated sediment from a liquid tank of the type having a drain existing thereon, said system comprising:

a tank drain valve, said drain valve movable between a normally closed position and an open position;

means for rapidly actuating said drain valve for moving said drain valve from said normally closed position to said open position for a predetermined period of time;

timing means for controlling said means for actuating, said means for controlling causing said means for actuating to periodically open said drain valve for a predetermined period of time thereby flushing sediment laden liquid from within the tank through said drain valve;

said timing means including a manual switch whereby a user may manually initiate and control actuation of said tank drain valve.

2. A system for automatically flushing accumulated sediment from a hot water tank according to claim 1, wherein said drain valve comprises a valve having a substantially unimpeded flow path when in an open configuration.

3. A system for automatically flushing accumulated sediment from a hot water tank according to claim 1, wherein said means for actuating comprises an electric actuator.

4. A system for automatically flushing accumulated sediment from a hot water tank according to claim 1, wherein said timing means comprises a time clock.

5. A system for automatically flushing accumulated sediment from a hot water tank of the type having a drain existing near the bottom of the tank, said system comprising:

a tank drain valve, said drain valve comprising a ball valve movable between a normally closed position and an open position;

an electric actuator connected to said drain valve, said actuator capable of rapid actuation of said drain valve from said normally closed position to said open position for a predetermined period of time;

a controller electrically connected to said electric actuator for controlling said electric actuator, said controller responsive to time and causing said electric actuator to periodically open said drain valve for a predetermined period of time thereby flushing sediment laden water from within the hot water tank through said drain valve;

said controller including a manual switch whereby a user may manually initiate and control actuation of said tank drain valve.

6. A system for automatically flushing accumulated sediment from a water tank, said tank of the type having a manual drain valve existing near the bottom of the tank, said system comprising:

an automatic valve installed as a replacement for said manual tank drain valve, said automatic valve including a valve structure movable between a normally closed position and an open position;

an electric actuator connected to said automatic valve, said actuator capable of rapid actuation of said automatic valve from said normally closed position to said open position;

a controller electrically connected to said electric actuator for controlling said electric actuator and actuation of said automatic valve, said controller having a clock means for keeping time and circuitry responsive to time for causing said electric actuator to periodically open said drain valve for a predetermined period of time thereby flushing sediment laden water from within the hot water tank through said drain valve;

said controller including a manual switch whereby a user may manually initiate and control actuation of said valve.

* * * * *